US012029335B2

(12) United States Patent
Volpe-Bonomo et al.

(10) Patent No.: US 12,029,335 B2
(45) Date of Patent: Jul. 9, 2024

(54) TRANSFORMABLE SNACK PLATE

(71) Applicants: Robert Volpe-Bonomo, Stuart, FL (US); Robert Volpe-Bonomo, Jr., Stuart, FL (US)

(72) Inventors: Robert Volpe-Bonomo, Stuart, FL (US); Robert Volpe-Bonomo, Jr., Stuart, FL (US)

( * ) Notice: Subject to any disclaimer, the term of this patent is extended or adjusted under 35 U.S.C. 154(b) by 0 days.

(21) Appl. No.: 18/173,343

(22) Filed: Feb. 23, 2023

(65) Prior Publication Data

US 2023/0276967 A1 Sep. 7, 2023

Related U.S. Application Data

(60) Provisional application No. 63/268,707, filed on Mar. 1, 2022.

(51) Int. Cl.
*A47G 19/03* (2006.01)

(52) U.S. Cl.
CPC ..... *A47G 19/03* (2013.01)

(58) Field of Classification Search
CPC ..... A47G 19/03; A47G 19/02
USPC ..... 220/574
See application file for complete search history.

(56) References Cited

U.S. PATENT DOCUMENTS

| | | | | | |
|---|---|---|---|---|---|
| 798,264 | A * | 8/1905 | Carrier | B65D 5/029 | 229/107 |
| 2,242,684 | A * | 5/1941 | Stuart | A21B 3/131 | 220/639 |
| 3,580,484 | A * | 5/1971 | Schneider | A21B 3/131 | 220/573.1 |
| 6,364,203 | B2 * | 4/2002 | Toussant | B65D 1/34 | 229/407 |
| 6,415,944 | B1 * | 7/2002 | Toussant | A47G 19/03 | 220/4.23 |
| 6,915,948 | B2 * | 7/2005 | George | B65D 85/36 | 229/906 |
| 2016/0058222 | A1 * | 3/2016 | Batten | A47G 19/03 | 220/574 |

* cited by examiner

*Primary Examiner* — Andrew D Perreault
(74) *Attorney, Agent, or Firm* — McNees Wallace & Nurick

(57) ABSTRACT

An eating utensil doubling as a plate and a bowl. A plate has a center, four quadrants, an outer plate edge and an underside. A perforation is formed through the plate extending from the center to the outer edge. Adhesive tape is secured to the underside, the tape including a receiving portion and spanning portion, the spanning portion being of a length substantially equal to the perforation and traveling adjacent to the perforation; and, the receiving portion disposed substantially perpendicular to the spanning portion, wherein upon one of the four quadrants being partially separated from the plate at the perforation to thereby form a quarter piece, the quarter piece can be folded and adhered to the receiving portion such that a cone-like bowl is formed from the plate. An accompanying generally rectangular strip forms the base of the bowl.

10 Claims, 7 Drawing Sheets

TRANSFORMABLE SNACK PLATE

CROSS-REFERENCE TO RELATED APPLICATIONS

The instant application claims benefit of U.S. Provisional Application Ser. No. 63/268,707, filed Mar. 1, 2022, the entire contents of which are incorporated herein by reference.

FIELD OF THE INVENTION

The present invention relates to eating utensil, plate products. More particularly, provided is a paper plate which is adapted to convert to a bowl.

DESCRIPTION OF THE RELATED ART

Paper plates are of course well known, as are bowls. Often these products are purchased separately and used in accordance with the type of product contained, e.g. a lunch sandwich may be eaten from a plate whereas a handful of popcorn or snacks would preferably be used with a bowl. A flat, plate-like server setting could be folded or manipulated into a bowl, but this would be cumbersome, and the only way to form a bowl from a plate would be to cut the plate then fold into a funnel.

Needed then is a plate which can be converted into a bowl without the need for extraneous supplies or effort, such that the serving dishes need not be stored and utilized separate from one another.

SUMMARY OF THE INVENTION

Comprehended generally is a paper or flexible plate convertible to a bowl, the convertible plate having features of: a plate; a radial perforation within one quadrant; double-sided, non-toxic tape on the underside of the plate; the tape spanning along the perforation with the additional, receiving portion of tape disposed ninety-degrees from the perforated edge; such that upon the quadrant portion being partially separated from the plate, the resulting quarter-piece is folded down on to the second tape portion to thereby form a cone-like bowl.

More particularly, the invention is an eating utensil, comprising: a plate having a center, four quadrants, an outer plate edge and an underside; a perforation formed through the plate extending from the center to the outer edge; adhesive tape secured to the underside, the tape including a receiving portion and spanning portion, the spanning portion being of a length substantially equal to the perforation and traveling adjacent to the perforation; and, the receiving portion disposed substantially perpendicular to the spanning portion, wherein upon one of the four quadrants being partially separated from the plate at the perforation to thereby form a quarter piece, the quarter piece can be folded and adhered to the receiving portion such that a cone-like bowl is formed from the plate.

The eating utensil further comprises a rectangular strip, wherein the rectangular strip has two strip ends, at least one of the strip ends having an adhesion means thereon, wherein the strip is adapted to be rolled with its ends secured to each other to thereby form a ring-like stand such that the ring-like stand can be situated on its edge to upstand and situate the cone-like bowl.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
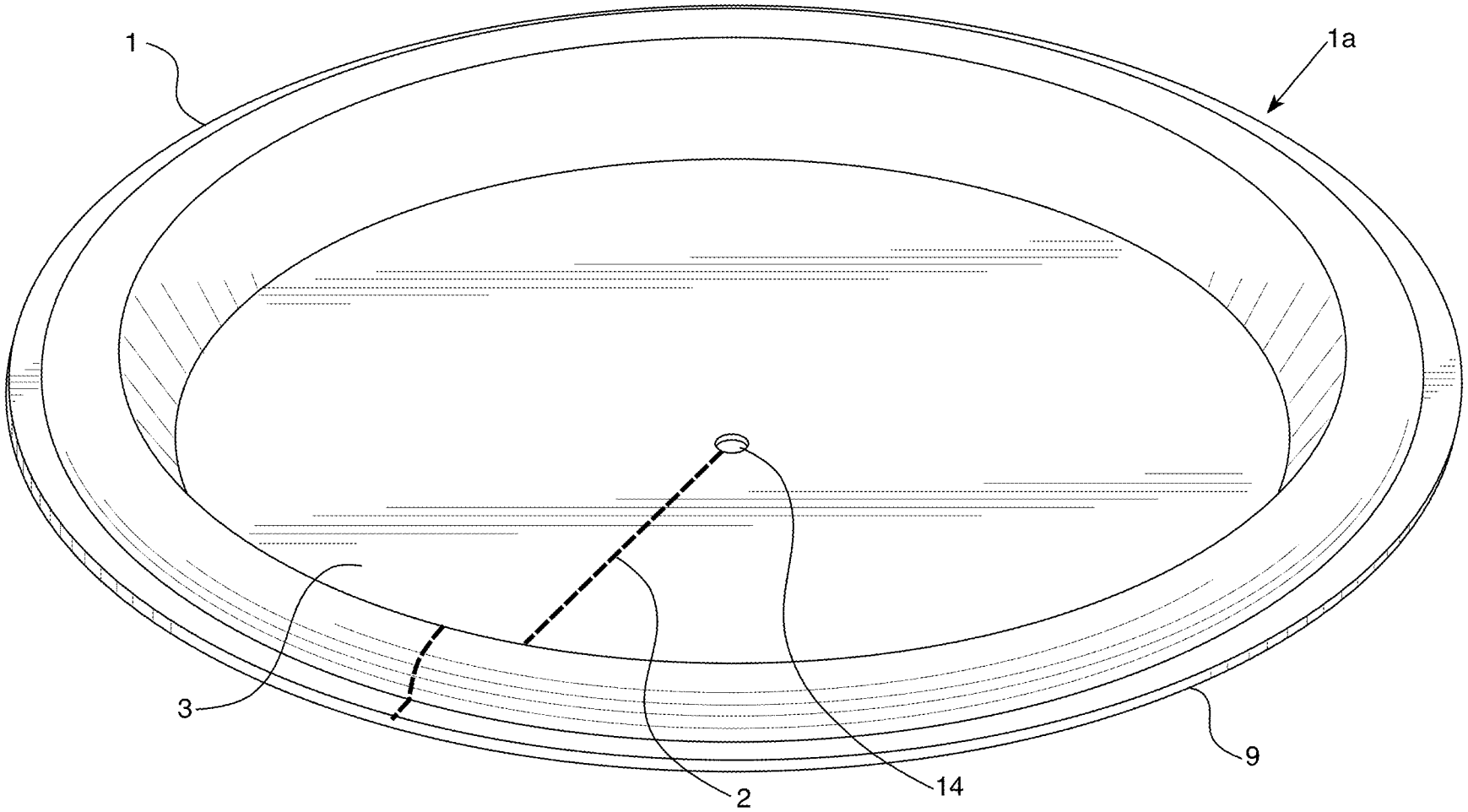
FIG. 1 shows a top perspective view of the convertible plate.
Figure 2:
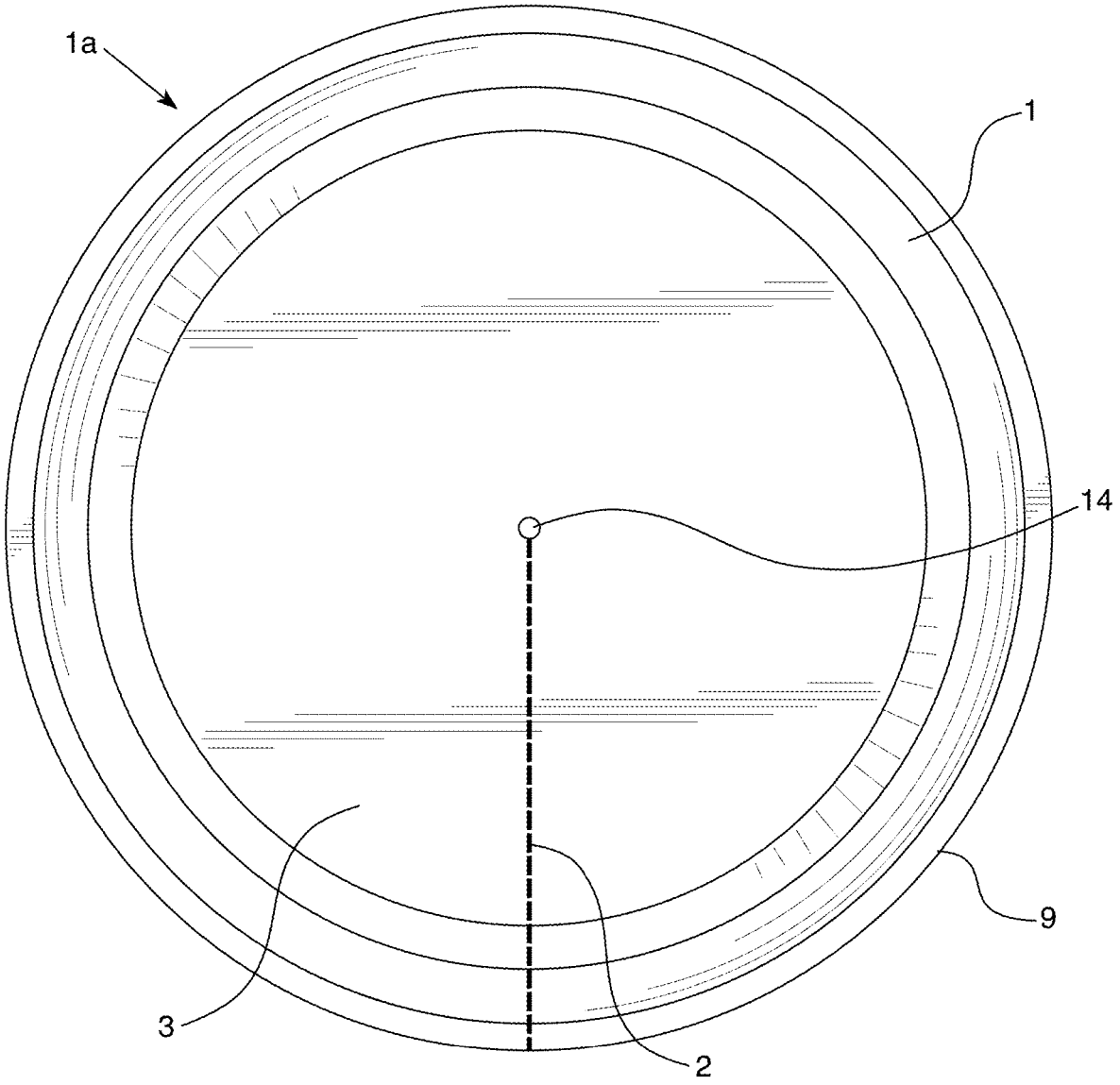
FIG. 2 shows a top view in elevation thereof.
Figure 3:
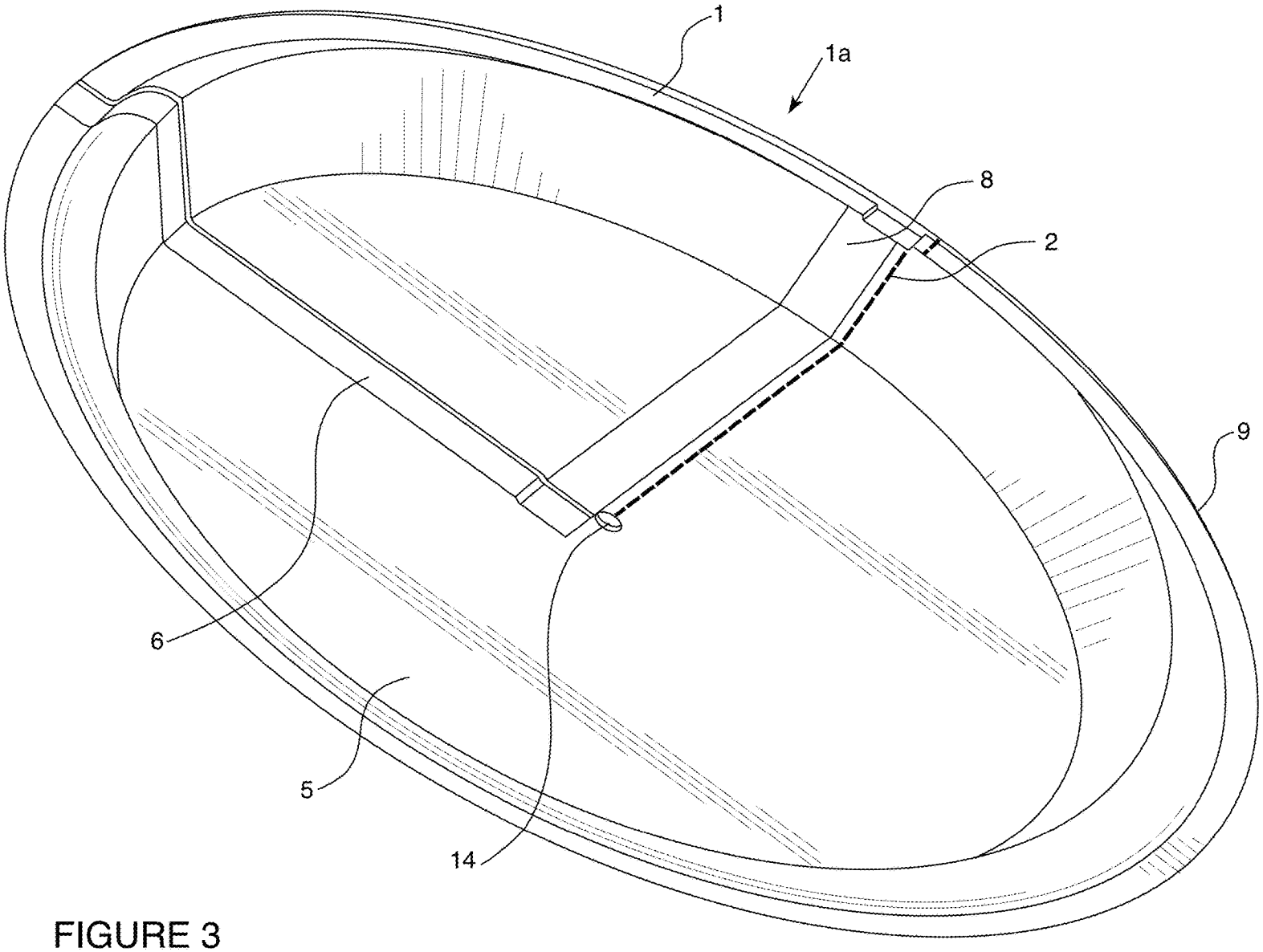
FIG. 3 shows a bottom perspective view showing the tape along the underside.
Figure 4:
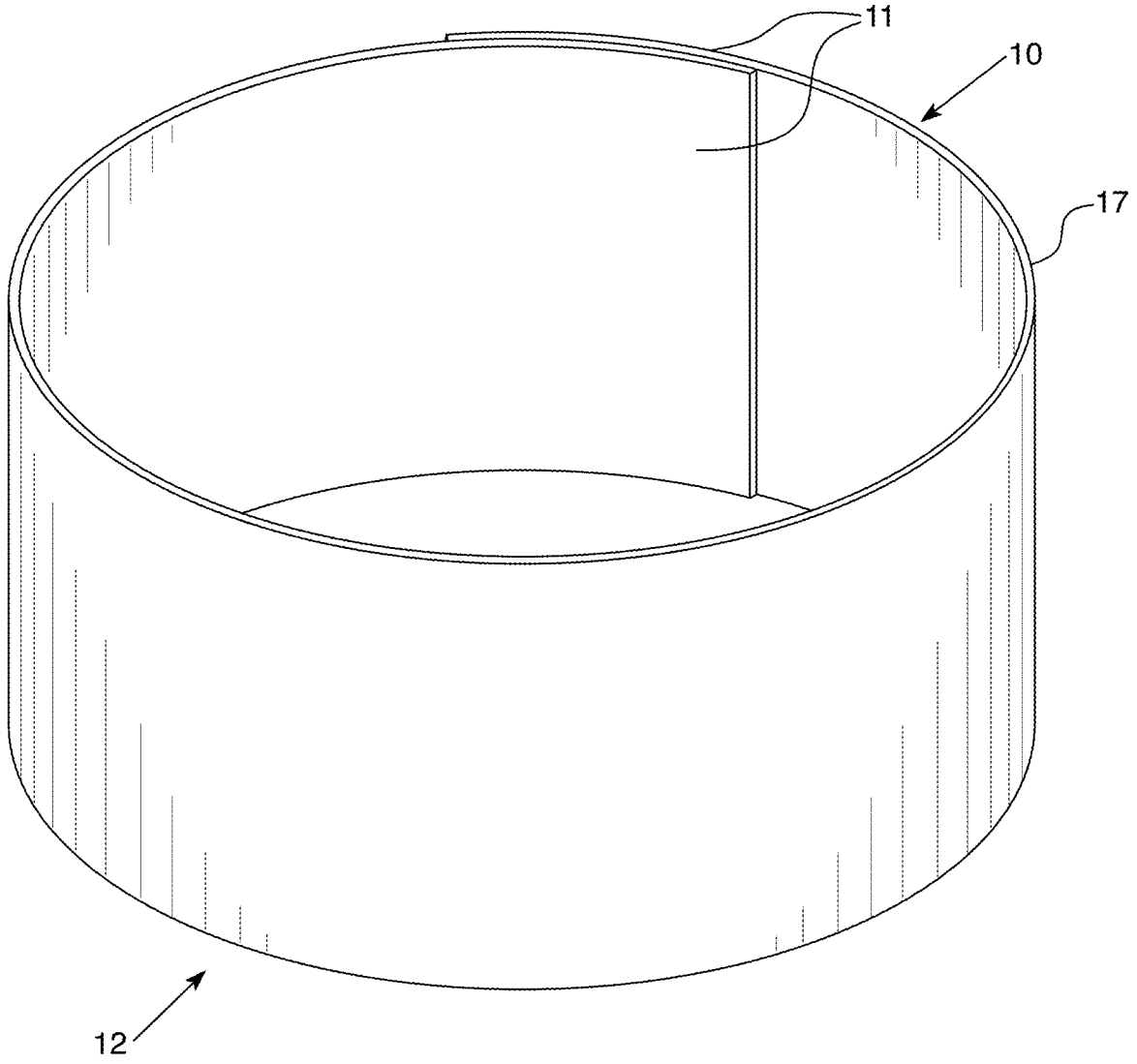
FIG. 4 shows a perspective view of the strip.

Referencing now FIGS. 1-7, shown is the instant eating utensil 1*a*, which can be formed of a combination or kit. First, a plate 1 has a center 14, four quadrants 3, an outer plate edge 9 and an underside 5. Plate 1 is a customary non-rigid, preferably paper plate 1. Defined within the plate 1 is a perforation 2, i.e. a radial perforation 2 within one quadrant 3 as shown. The perforation 2 is formed through the plate 1 extending from the center 14 to the outer plate edge 9. Traveling proximate to the perforation 2 and generally aligned therewith is a double-sided, non-toxic tape 4 on the underside 5 of the plate 1. In other words, tape 4 is secured to the underside 5. The tape 4 can be formed of any tacky-like embodiment revealed by a peel-away strip or wax, the double-sided tape 4 being a preferred embodiment.

Tape 4 is defined herein to include two separate portions, namely a receiving portion 6 and a spanning portion 8. As shown, the spanning portion 8 has a length substantially equal (i.e nearly equal, less subtle variations due to manufacturing margin of error) to the perforation 2. Spanning portion 8 travels adjacent to the perforation 2, along the perforation 2 situated just near but not covering the perforation 2 and generally parallel thereto, with the additional receiving portion 6 of tape 4 disposed about ninety-degrees (substantially perpendicular) from the perforation 2 (and thus the spanning portion 8). The tape 4 is revealed, then upon the quadrant portion being partially separated from the plate 1 by way of the perforation 2 being torn, the resulting quarter-piece 7 (now separated quadrant) is folded down on to the receiving portion 6 to thereby form a cone-like bowl 13 as shown.

Figure 5:
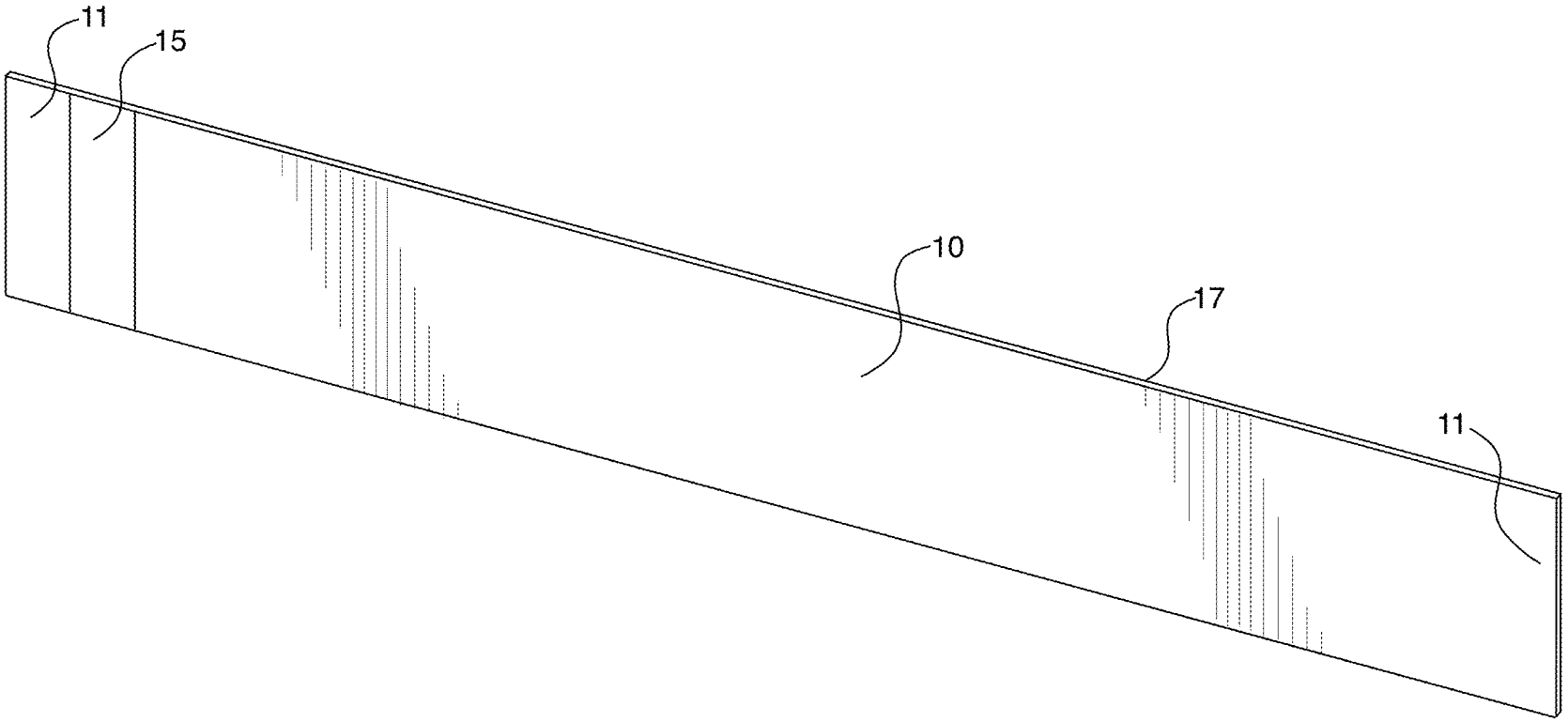
FIG. 5 shows another view of the strip in its uncoiled position.
Figure 6:
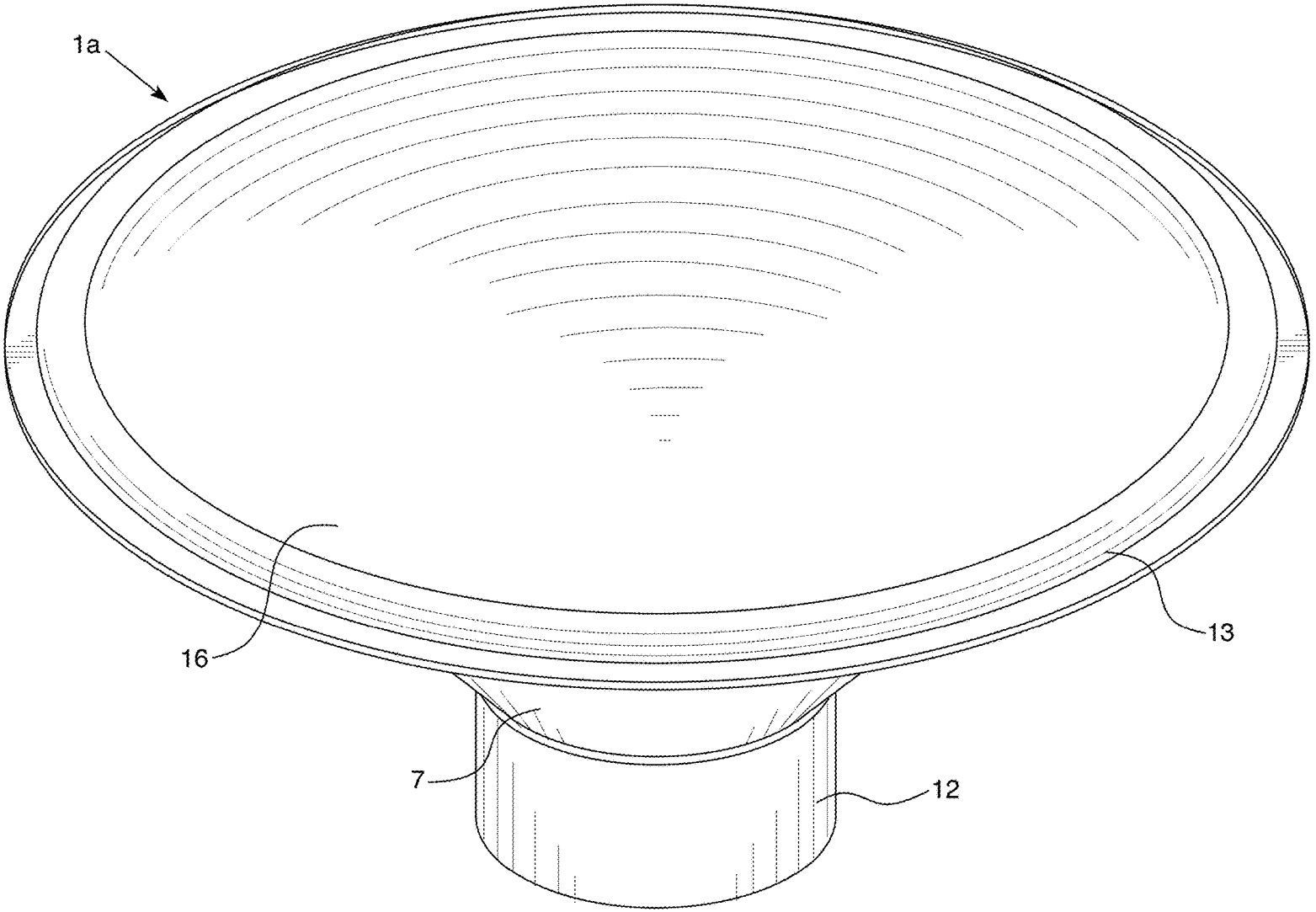
FIG. 6 shows a perspective view of the combination formed-bowl and base formed from the rolled strip.
Figure 7:
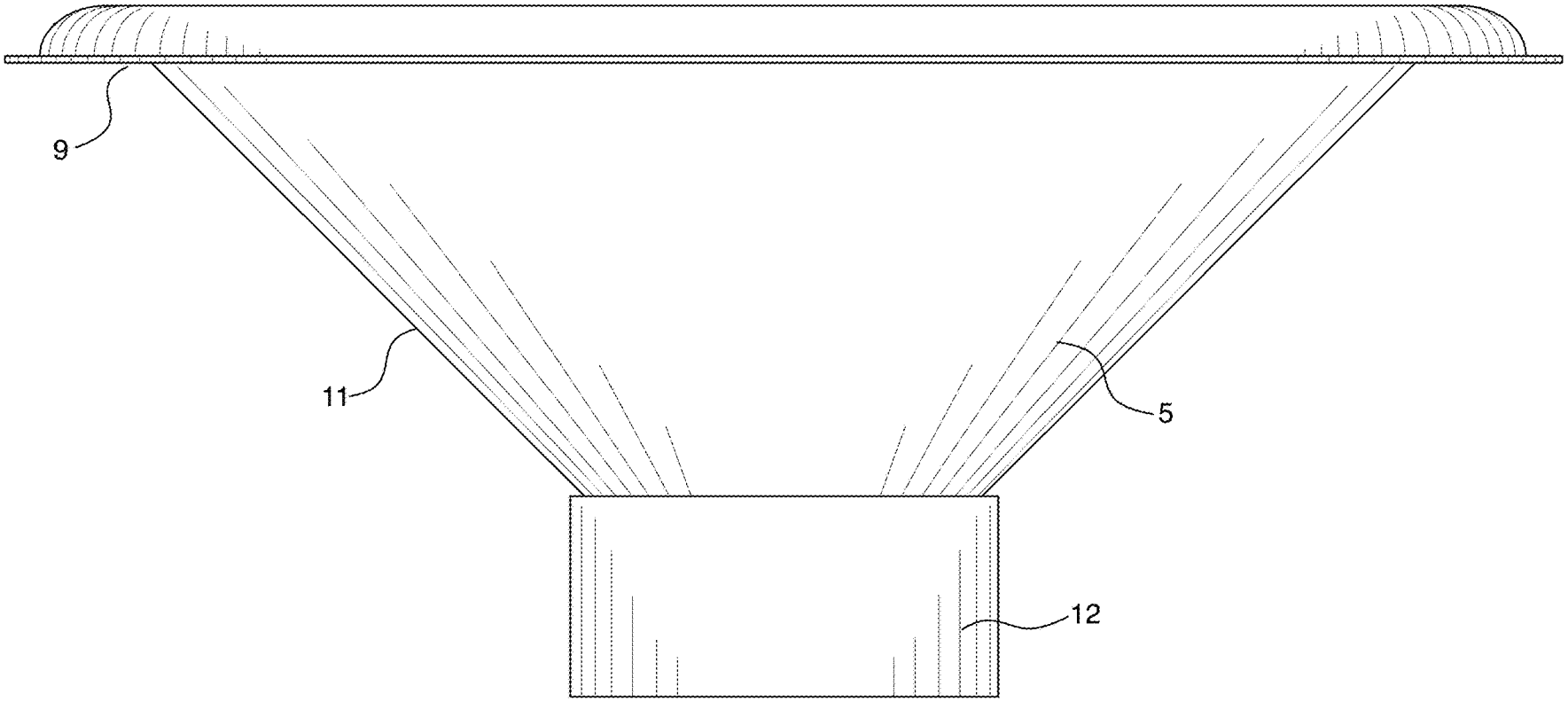
FIG. 7 shows the embodiment of FIG. 6 in a side, elevational view.

Referencing now FIGS. 5-7, in a further embodiment, a rectangular strip 10 is included with the plate 1 (i.e. combination or kit of components). The rectangular strip 10 has two strip ends 11, with at least one of the strip ends 11 having an adhesion means 15. Adhesion means 15 is a tacky substance revealed, for instance, by peeling away a tab or similar, much like tape 4, wherein the strip 10 is adapted to be rolled with its ends 11 secured to each other to thereby form a ring-like stand 12. The ring-like stand 12 can be situated on its strip edge 17 to upstand and situate the cone-like bowl 13 thereon, much like a base therefore. The now-formed bowl 13 can be situated and held by the stand 12 for hands-free access to the bowl 13.

Therefore, in use, termed herein the "Snack Plowl", described is the design of an eating utensil 1*a* formed of a paper plate 1 with a perforated line 2 from the center 14 to the outer plate edge 9 following the radius line, this perforation 2 allowing the person using the plate 1 to tear the plate 1 on the perforation 2. Then there are two double sided adhesive strips (6, 8) on the underside 5 of the plate 1, the user removes the wax coating from both adhesive strips and by curling the plate in a funnel like shape then compressing the torn perforated edge 2 to the furthest adhesive strip (receiving portion 6) and then compressing the part of the plate 1 to the remaining adhesive strip (spanning portion 8), this ultimately turns the plate 1 into a snack bowl 13. Also, within the package of plates 1 will be a rectangular strip 10 of the same material that when a similar strip of adhesive bonding has its wax covering removed, and the rectangular strip 10 is curled into a bracelet shaped form and the outer edge/end 11 is compressed onto the adhesive strip 10. When this is set down open side facing up and down, the cone shaped snack bowl 13 can be set inside and used as a base or stand 13 to stand the bowl 13 upright.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. An eating utensil, comprising:

a plate having a center, four quadrants, an outer plate edge and an underside;

a perforation formed through said plate extending from said center to said outer edge;

adhesive tape secured to said underside, said tape including a receiving portion and spanning portion, said spanning portion being of a length substantially equal to said perforation and traveling adjacent to said perforation; and, said receiving portion disposed substantially perpendicular to said spanning portion, wherein upon one of said four quadrants being partially separated from said plate at said perforation to thereby form a quarter piece, said quarter piece can be folded and adhered to said receiving portion such that a cone-like bowl is formed from said plate.

2. The eating utensil of claim 1, further comprising a rectangular strip.

3. The eating utensil of claim 2, wherein said rectangular strip has two strip ends, at least one of said strip ends having an adhesion means thereon, wherein said strip is adapted to be rolled with its ends secured to each other to thereby form a ring-like stand such that said ring-like stand can be situated on its edge therefor to upstand and situate said cone-like bowl.

4. An eating utensil, comprising:

a plate having a center, four quadrants, an outer plate edge and an underside;

a perforation formed through said plate extending from said center to said outer plate edge;

in combination with said plate, a rectangular strip having two strip ends;

at least one of said strip ends having an adhesion means thereon, wherein said strip is adapted to be rolled with its ends secured to each other to thereby form a ring-like stand such that said ring-like stand can be situated on its edge therefor to upstand and situate said plate.

5. The eating utensil combination of claim 4, further including an adhesive tape secured to said underside.

6. The eating utensil combination of claim 5, wherein said tape includes a receiving portion and spanning portion, said spanning portion being of a length substantially equal to said perforation and traveling adjacent to said perforation.

7. The eating utensil combination of claim 6, wherein said receiving portion is disposed substantially perpendicular to said spanning portion, wherein upon one of said four quadrants being partially separated from said plate at said perforation to thereby form a quarter piece, said quarter piece can be folded and adhered to said receiving portion such that a cone-like bowl is formed from said plate.

8. The eating utensil combination of claim 1, wherein said spanning portion is substantially parallel to said perforation.

9. The eating utensil combination of claim 6, wherein said spanning portion is substantially parallel to said perforation.

10. An eating utensil kit, comprising:

a plate having a center, four quadrants, an outer plate edge and an underside;

a perforation formed through said plate extending from said center to said outer plate edge;

adhesive tape secured to said underside, said tape including a receiving portion and spanning portion, said spanning portion being parallel to said perforation and said spanning portion having a length substantially equal to said perforation;

said receiving portion disposed substantially perpendicular to said spanning portion, wherein upon one of said four quadrants being partially separated from said plate at said perforation to thereby form a quarter piece, said quarter piece can be folded and adhered to said receiving portion such that a cone-like bowl is formed from said plate;

a rectangular strip having two strip ends; and, at least one of said strip ends having an adhesion means thereon, wherein said strip is adapted to be rolled with its said ends then secured to each other to thereby form a ring-like stand such that said ring-like stand can be situated on its edge therefor to upstand and situate said cone-like bowl.

* * * * *